US007353846B2

(12) United States Patent
Kusakari et al.

(10) Patent No.: US 7,353,846 B2
(45) Date of Patent: Apr. 8, 2008

(54) MOTOR-DRIVEN REINFORCING ROD BINDING MACHINE

(75) Inventors: Ichiro Kusakari, Tokyo (JP); Atsushi Matsuoka, Tokyo (JP)

(73) Assignee: Max Co., Ltd., Tokyo (JP)

( * ) Notice: Subject to any disclaimer, the term of this patent is extended or adjusted under 35 U.S.C. 154(b) by 108 days.

(21) Appl. No.: 10/567,861

(22) PCT Filed: Aug. 6, 2004

(86) PCT No.: PCT/JP2004/011637

§ 371 (c)(1),
(2), (4) Date: Feb. 10, 2006

(87) PCT Pub. No.: WO2005/014398

PCT Pub. Date: Feb. 17, 2005

(65) Prior Publication Data

US 2006/0254666 A1 Nov. 16, 2006

(30) Foreign Application Priority Data

Aug. 12, 2003 (JP) ..... 2003-292516

(51) Int. Cl.
*B21F 9/02* (2006.01)
*B21F 25/00* (2006.01)
*B65B 13/28* (2006.01)

(52) U.S. Cl. ..... 140/93.6; 140/57; 100/31

(58) Field of Classification Search ..... 140/57, 140/93.2, 93.6, 118, 149; 100/29, 31, 32; 173/2, 217

See application file for complete search history.

(56) References Cited

U.S. PATENT DOCUMENTS 3,125,326 A * 3/1964 Ericsson ..... 140/93.4
5,682,927 A * 11/1997 Takahashi et al. ..... 140/119
6,654,894 B2 * 11/2003 Kaminski et al. ..... 713/300
2004/0206251 A1 * 10/2004 Nix ..... 100/29

FOREIGN PATENT DOCUMENTS

JP A 62-291421 12/1987
JP U 5-3494 1/1993

(Continued)

*Primary Examiner*—Derris H. Banks
*Assistant Examiner*—Teresa M Bonk
(74) *Attorney, Agent, or Firm*—Morgan, Lewis & Bockius LLP

(57) ABSTRACT

A cooling fan 17 is arranged on the rear side of a twisting motor 9 of a reinforcing bar binder 1. The cooling fan is located on the axial line of the twisting motor so that cooling air effectively flows along the surface of the twisting motor and through within the twisting motor. A control unit on-off controls the cooling fan according to the temperature detected by a heat sensitive element 23 so as to actuate the cooling fan when a trigger signal is received at an interior temperature not lower than a reference value and to stop it after a predetermined time elapses. Thus, the temperature of the reinforcing bar binder can be controlled within a safe temperature range. Even if the reinforcing bar binder is run during a long time, a protecting circuit is not operated to forcibly stop the reinforcing bar binder. Further, in a cold environment, the cooling fan is not actuated so that the performance at a low temperature is not deteriorated and so power consumption can be also saved.

11 Claims, 5 Drawing Sheets

FOREIGN PATENT DOCUMENTS

| | | |
|---|---|---|
| JP | U 7-7805 | 2/1995 |
| JP | A 7-208388 | 8/1995 |
| JP | A 10-250703 | 9/1998 |
| JP | A 2003-64876 | 3/2003 |
| JP | A 2003-147962 | 5/2003 |

* cited by examiner

MOTOR-DRIVEN REINFORCING ROD BINDING MACHINE

TECHNICAL FIELD

This invention relates to a motor-driven reinforcing bar binder, and more particularly to a cooling device for the reinforcing bar binder having a temperature control function.

BACKGROUND ART

There is previously known motor-driven reinforcing bar binders which are provided with a binding wire feeding mechanism for feeding a binding wire being bent in a loop shape to be wound over a reinforcing bar and a binding wire twisting mechanism for twist and binding the binding wire wound around the reinforcing bar, wherein a binding wire feeding operation and a binding wire twisting operation are successively performed by a trigger operation to perform a once-cycle binding operation (see, e.g. JP-U-05-003494 and JP-A-2003-064876). These reinforcing bar binders include a single-motor type in which the binding wire feeding mechanism and the binding wire twisting mechanism are driven by a single motor and a two-motor type in which the binding wire feeding mechanism and the binding wire twisting mechanism are driven by different motors, respectively. However, in either type, the operation of twisting the binding wire is subjected to considerable load and the motor in charge of the twisting operation generates a large quantity of heat.

As a means for dissipating the heat generated by an electric tool, there is a previously known method in which the interior of a housing inclusive of the motor is cooled during motor rotation by a wind supplied by a fan attached to a motor shaft (see, e.g. JP-U-07-007805). However, in the reinforcing bar binder, in which the operation pattern of the motor is different from that of the electric tool such as an electric drill or an electric driver, a sufficient motor cooling effect cannot be obtained by the fan which rotates simultaneously with the motor. Therefore, the reinforcing bar binders have not been specially provided with cooling means such as fans.

The operation pattern of the reinforcing bar binder is a short-time high speed operation in which the one cycle consisting of the operation of the binding wire feeding mechanism and that of the binding wire twisting mechanism is not longer than 1 sec. More specifically, the operation of the twisting mechanism includes an operation of closing a tip of the twisting mechanism so as to grasp the binding wire, a twisting operation of rotating the twisting mechanism and an operation of reversing the motor to release the binding wire so that the twisting mechanism is restored to an initial position. The motor changes between a normal rotation and a reverse rotation in a short period. Therefore, even with the fan attached to the motor shaft, the rotation time within the one cycle is short. In addition, the rotation of the fan is reversed soon and the number of rotations is also few. Thus, a satisfactory cooling effect cannot be expected. Accordingly, in the conventional reinforcing bar binder, in place of a cooling device, a protecting circuit using a temperature detecting element is provided so that when the temperature within a housing reaches a predetermined upper limited temperature, a power source circuit is interrupted to prevent the motors, circuit elements or the housing from being burned.

As described above, since the conventional reinforcing bar binder is not specially provided with the cooling mechanism, if the binding operation is performed continuously for a long period, the interior temperature gradually rises. As a result, the protecting circuit is activated to interrupt the power source. In this case, the reinforcing bar binder cannot be employed until the interior temperature falls to a safety reference value. In a large-scale construction scene such as bridge or road construction, although the reinforcing bar binder is continuously driven all day long, it cannot be employed owing to temperature rise so that working must be interrupted. This may leads to delay in a work schedule.

In order to obviate such an inconvenience, any cooling means is required. For example, if the reinforcing bar binder is simply provided with an electric fan connected to a power switch, the electric fan which always rotates consumes a large quantity of electric power. This leads to an inconvenience of shortening the duration of a battery of the reinforcing bar binder. Further, in a very low temperature environment in which the atmospheric temperature is not higher than 0° C., the viscosity of lubricant applied to a rotating mechanism portion of the reinforcing bar binder lowers to increase the operation resistance and reduce the battery capacity. So, unless an warm-up is carried out to some extent, the primary performance cannot be shown. In the electric fan which always rotates, air is sent in a low temperature environment also. This leads to a problem that the interior of the reinforcing bar binder is cooled to the temperature not higher than a suitable operation temperature to deteriorate the performance.

DISCLOSURE OF THE INVENTION

In view of the above circumstance, an object of the invention is to provide a cooling device which can control the temperature of a reinforcing bar binder within an appropriate range to permit its long-time continuous operation and extremely suppress power consumption due to cooling.

In order to attain the above object, in accordance with the invention, a motor-driven reinforcing bar binder is provided with: a binding wire feeding mechanism for feeding a binding wire to be wound around a reinforcing bar; a binding wire twisting mechanism for grasping and twisting a loop of the binding wire wound around the reinforcing bar so as to bind the reinforcing bar; a cooling fan provided within a housing of the reinforcing barbinder; temperature detecting means for detecting an interior temperature of the reinforcing bar binder; and means for comparing the temperature detected by the temperature detecting means with a reference temperature; and a fan driving control means for on-off controlling the cooling fan according to a comparison result. The cooling fan is driven when the interior temperature of the reinforcing bar binder exceeds the reference temperature.

Further, a motor-driven reinforcing bar binder is provided with: a binding wire feeding mechanism for feeding a binding wire to be wound around a reinforcing bar; a binding wire twisting mechanism for grasping and twisting a loop of the binding wire wound around the reinforcing bar so as to bind the reinforcing bar; a cooling fan provided within a housing of the reinforcing bar binder; a fan driving control means for on-off controlling the cooling fan; a timer means for counting a fan driving time. Driving of the cooling fan is started when a trigger signal for a binding operation is received, and is stopped after a predetermined time elapses.

Further, a motor-driven reinforcing bar binder is provided with: a binding wire feeding mechanism for feeding a binding wire to be wound around a reinforcing bar; a binding wire twisting mechanism for grasping and twisting a loop of the binding wire wound around the reinforcing bar so as to bind the reinforcing bar; a cooling fan provided within a housing of the reinforcing barbinder; temperature detecting means for detecting an interior temperature of the reinforcing bar binder; and a means for comparing the temperature detected by the temperature detecting device with a reference temperature; and a fan driving control means for on-off controlling the cooling fan according to a comparison result. Driving of the cooling fan is started when the interior temperature of the reinforcing bar binder exceeds the reference temperature and a trigger signal for a binding operation is received, and is stopped after a predetermined time elapses.

Further, there is provided a cooling device for a reinforcing bar binder including a control means for resetting a counting operation of the timer means if a trigger signal for a binding operation is received during a period from when driving of the cooling fan device has been started to when a predetermined fan driving time has elapsed.

Further, there is provided a cooling device for a reinforcing bar binder wherein the cooling fan is arranged on the rear side of a driving motor for the binding wire twisting mechanism and on or in the vicinity of an axial line of the driving motor.

The invention has attained the object of realizing continuous running of the reinforcing bar binder during a long time, by installing a cooling fan in the reinforcing bar binder and on-off controlling the cooling fan according to the interior temperature of the reinforcing bar binder.

Figure 1:
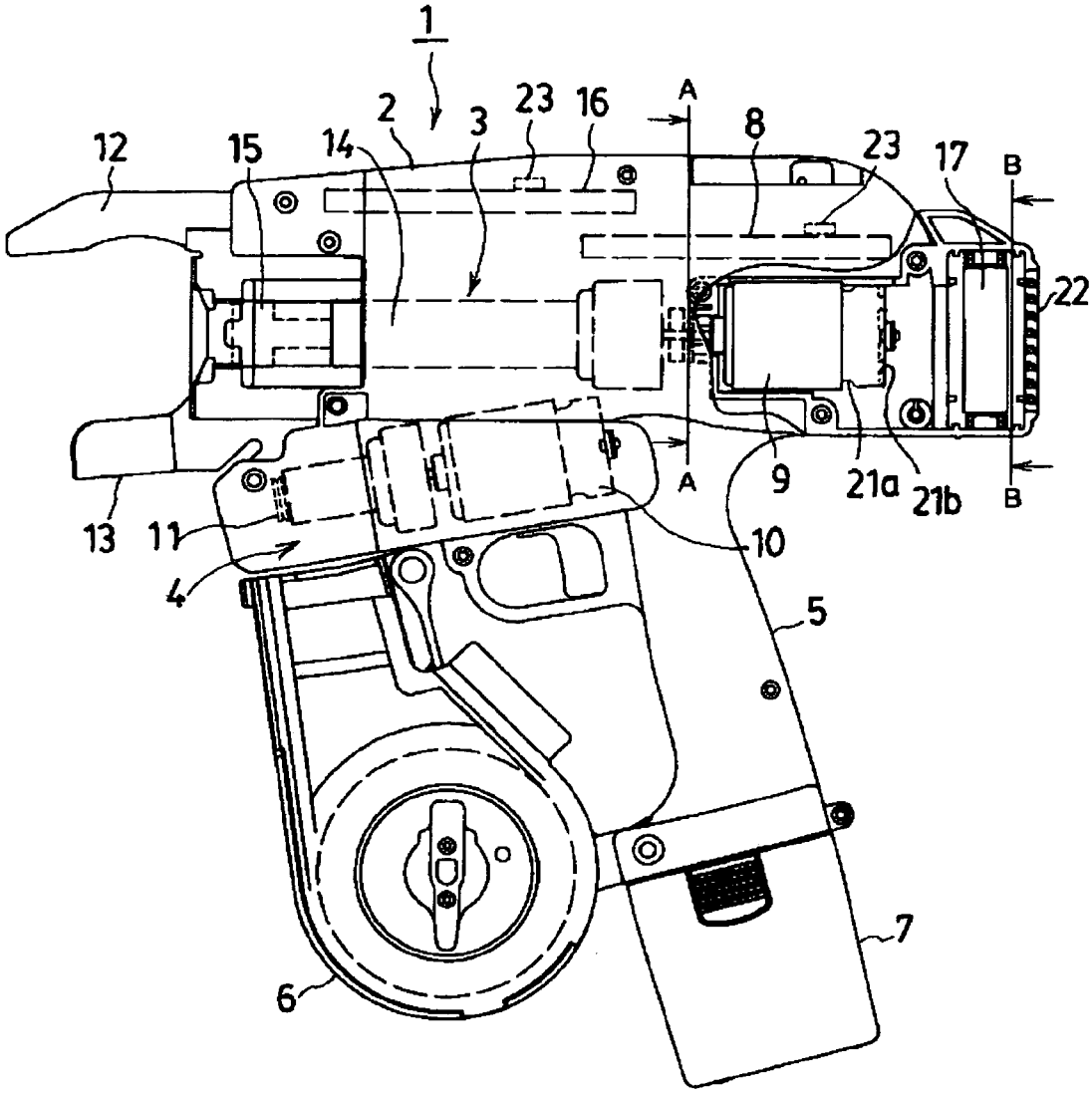
FIG. 1 is a side view of a mode of a reinforcing bar binder according to the invention.

In these figures, reference numeral 1 denotes a reinforcing bar binder; 2 a housing; 3 a binding wire twisting mechanism; 4 a binding wire feeding mechanism; 7 a battery; 8 a power supply circuit board; 9 a twisting motor; 10 a feeding motor; 16 a control circuit board; 17 a cooling fan device; 22 an exhausting slit; and 23 a heat sensitive element (temperature detecting device).

BEST MODE FOR CARRYING OUT THE INVENTION

First Embodiment

FIG. 1 shows a reinforcing bar binder 1. A housing 2 incorporates a binding wire twisting mechanism 3 and a binding wire feeding mechanism 4. Within a magazine 6 arranged in front of a grip 5 of the housing 2, a binding wire reel (not shown) is loaded. On the end of the grip 5, a battery 7 is loaded to supply, through a power supply circuit board 8 (inclusive of a control circuit), electric power to a twisting motor 9 of the binding wire twisting mechanism 3 and a feeding motor 10 of the binding wire feeding mechanism 4.

The binding wire feeding mechanism 4 has two V-groove equipped gears 11 in mesh with each other, arranged in a front-rear direction of paper face in FIG. 1. The one V-groove equipped gear is driven by the motor 10, and the binding wire sandwiched by the two V-groove equipped gears 11 is fed. The binding wire wound on the binding wire reel is fed out upwards by the binding wire feeding mechanism 4. The binding wire thus fed out is shaped in an arc along the guide groove on the inner periphery of an upper nose 12 to turn around a reinforcing bar. The tip of the binding wire is fed into the binding wire twisting mechanism 3 along a lower guide plate 13.

The binding wire twisting mechanism 3 includes a twisting shaft 14 and three clamping plates 15 (arranged in a front-rear direction in FIG. 1). The two clamping plates arranged on both sides of the central clamping plate opens/closes a cam mechanism. The binding wire is fed out through between the central clamping plate and the one outer clamping plate. The binding wire turns around the reinforcing bar and enters between the other outer clamping plate and the central clamping plate. When the outer clamping plate is closed to clamp the tip of the binding wire. After the front end of the binding wire has been clamped, the binding wire feeding mechanism 4 is driven in a reverse direction to pull back the binding wire. With the binding wire being wound on the reinforcing bar, the one outer clamping plate described above is closed so that the rear end of a loop of the binding wire is clamped by this clamping plate and the central clamping plate.

And a cutter device (not shown) cuts the rear end of the binding wire loop. With both ends of the binding wire loop being clamped, a twisting shaft 14 is rotated to twist both ends of the binding wire loop, thereby binding the reinforcing bar. The respective operating steps of one cycle consisting of feeding the binding wire, clamping the front end of the binding wire loop, pulling-back of the binding wire, clamping the rear end of the binding wire loop, cutting the binding wire, twisting the binding wire and restoring to an initial position are successively executed by the control of a microprocessor (not shown) mounted to a control circuit board.

Figure 2:
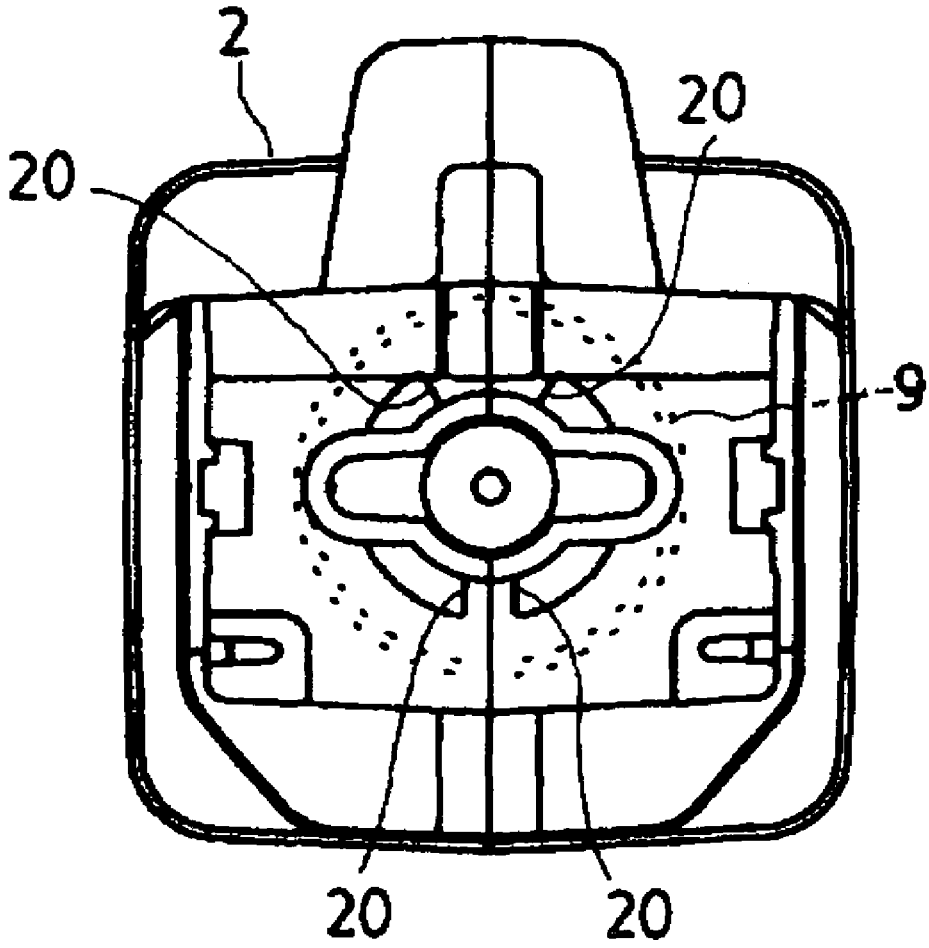
FIG. 2 is a view taken in an arrow line A-A in FIG. 1.
Figure 3:
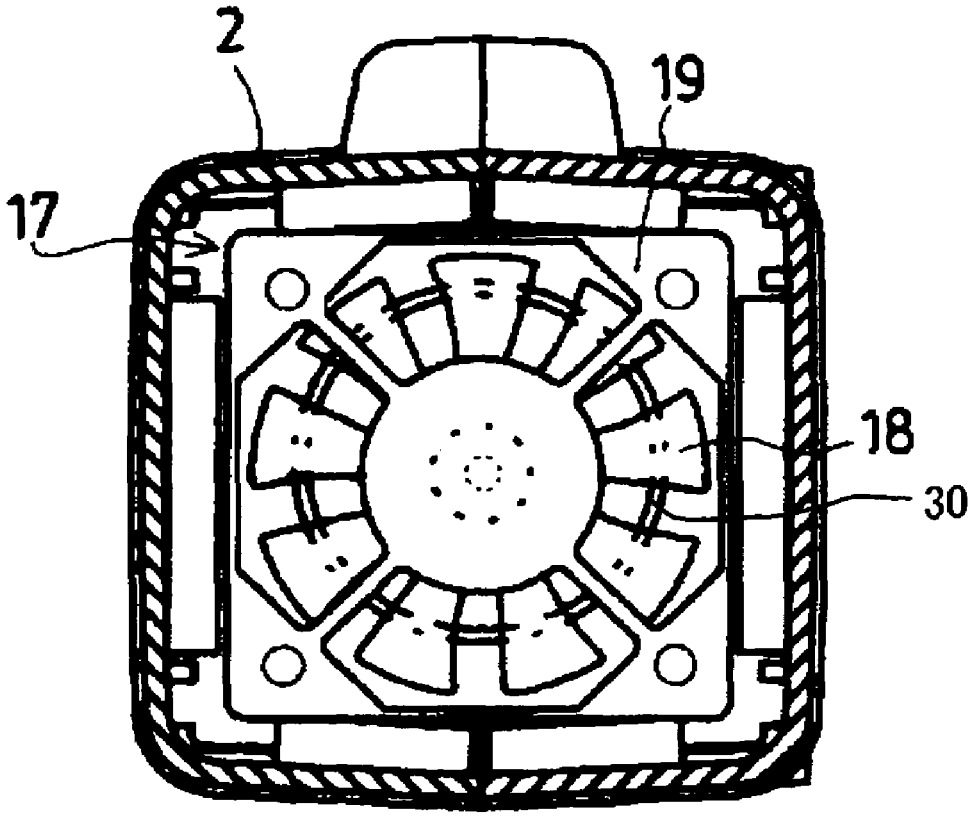
FIG. 3 is a view taken in an arrow line B-B in FIG. 1.

In the reinforcing bar binder 1, as a cooling means for cooling the interior of the housing 2, a cooling fan device 17 is arranged at the rear end (right side in FIG. 1) of the housing 2. The operation of the cooling fan device 17 is controlled by a temperature control circuit arranged on the control circuit board 16. The cooling fan device 17 is a unit in which a motor 30 and a fan 18 are accommodated within a fan case 19. As seen from FIGS. 1 to 3, the axial line of the cooling fan 17 is located to be substantially identical to the axial line of the twisting motor 9. Thus, when the fan 18 is rotated, air is sucked from vents 20 at the front of the twisting motor 9 shown in FIG. 2. The air flows out from slits 21*a* on the side of the rear of the twisting motor 9 and slits 21*b* on the rear end thereof, as shown in FIG. 1. The heated air is exhausted through the cooling fan 17 from exhaust slits 22 on the rear end thereof. Thus, the twisting motor 9 which is the greatest heat generating source can be effectively cooled. The temperature control circuit on-off controls the cooling fan device 17 by means of heat sensitive elements (thermistors) 23 serving as the temperature detecting devices loaded on the power supply circuit board 8 and control circuit board 16, and a comparison control means (comparing means) constructed by a microprocessor or a detecting circuit.

Figure 4:
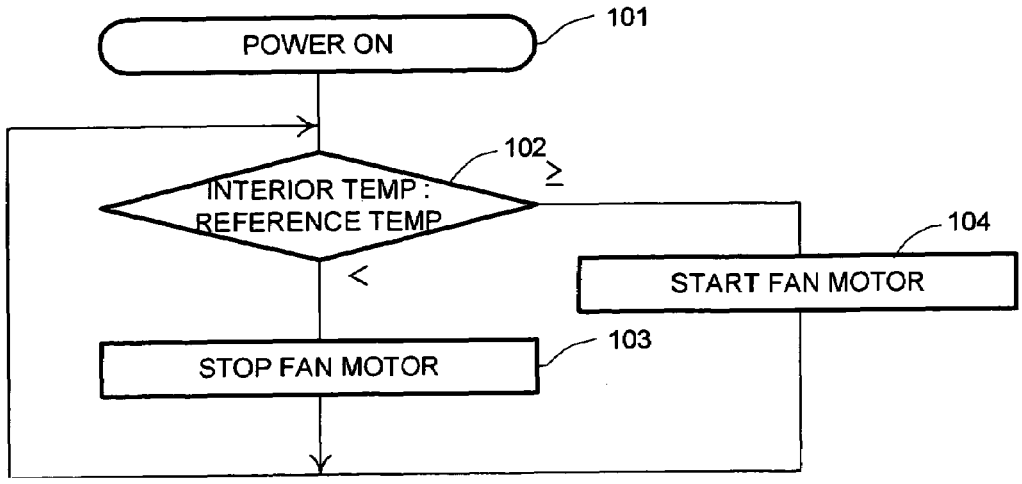
FIG. 4 is a flowchart of temperature control in the reinforcing bar binder according to the first embodiment of the invention.

FIG. 4 shows a control routine of the temperature control circuit. In FIG. 4, when a main switch (not shown) of the reinforcing bar binder 1 is turned on to turn on the power (step 101), information on the interior temperature of the reinforcing barbinder is sequentially supplied to the comparison control means through the heat sensitive elements 23. Then, the interior temperature is compared with a reference temperature (temperature near the upper limit of the range not injuring the machine, e.g. 80° C. to 90° C.) (step 102). If the interior temperature is not higher than the reference temperature, the cooling fan is kept at a stopped state (step 103). With the progress of the binding operation, if the interior temperature of the reinforcing barbinder exceeds the reference temperature, the cooling fan 17 is actuated (step 104). When the interior temperature falls to the reference temperature or less, the cooling fan 17 is stopped (step 102→step 103).

Thus, until the interior temperature of the reinforcing bar binder 1 exceeds the reference temperature, the cooling fan 17 is not actuated. Only at the high temperature, air blowing by the cooling fan 17 is carried out. When the interior temperature falls to the reference temperature or less, the cooling fan 17 is stopped. Accordingly, wasteful power consumption can be prevented. As a result, the long period continuous running of the reinforcing bar binder can be realized without operating the protecting device for the reinforcing bar binder.

Second Embodiment

Figure 5:
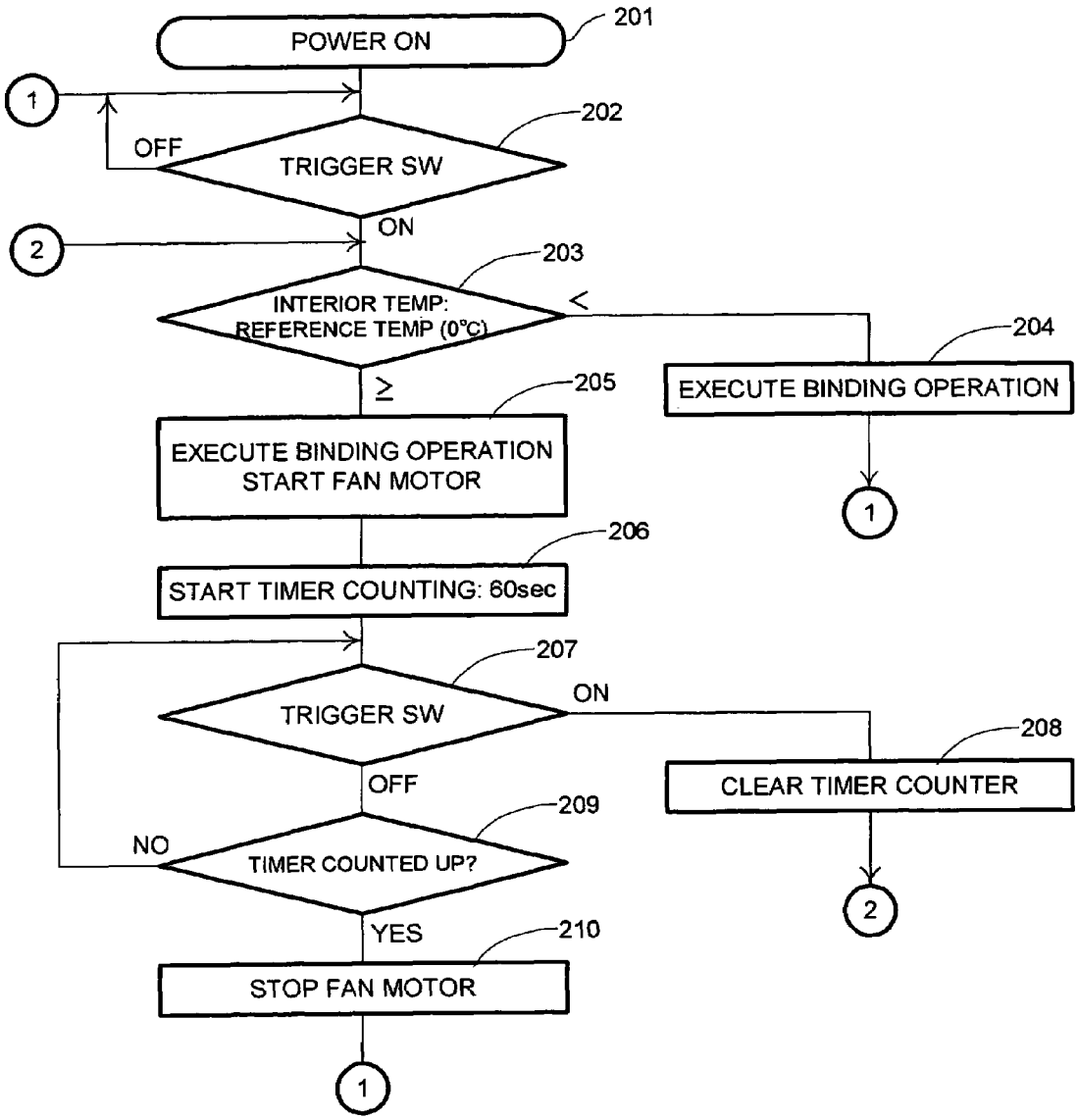
FIG. 5 is a flowchart of temperature control according to the second embodiment of the invention.

An example of more precise control than the first embodiment is shown in FIG. 5. When the main switch of the reinforcing bar binder 1 is turned on to turn on the power (step 201), information on the interior temperature of the reinforcing bar binder is sequentially supplied to the comparison control means through the heat sensitive elements. And if the trigger switch for the reinforcing bar binder is operated to input an ON signal (step 202), the interior temperature at this time is compared with a reference temperature (now, for example, 0° C.) (step 203). If the interior temperature is not higher than the reference temperature, without actuating the cooling fan 17, the binding operation is executed (step 204). Upon completion of the one cycle binding operation, the control processing is returned to step 202.

If the interior temperature exceeds 0° C., the binding operation is executed and the cooling fan 17 is also actuated (step 205). Counting of a predetermined on-duration (e.g. 60 sec) of the fan motor is started (step 206). If the trigger switch is turned on during this timer counting (step 207), the timer counting is stopped and cleared (step 208), and then the control processing returns to step 203. According to the interior temperature, the binding operation is executed (step 204), or otherwise the binding operation is executed and also the cooling fan 17 is actuated (step 205).

Further, if the trigger switch is not operated within 60 sec from the completion of the binding operation, simultaneously with count-up of 60 sec, the fan motor is stopped (step 210). Then, the control processing returns to step 202 in which the trigger switch stands by.

Accordingly, if the interior of the reinforcing bar binder 1 is cold in a cold environment, the cooling fan 17 is not actuated. On the other hand, if the interior of the reinforcing bar binder 1 is not lower than the reference temperature, the binding mechanism is actuated and also the cooling fan 17 is driven. When a predetermined time elapses after completion of the binding, the cooling fan 17 is stopped. Thus, the rise of the interior temperature can be suppressed to the utmost to permit the long period continuous running of the reinforcing bar binder, and power consumption of the cooling fan can be minimized.

Incidentally, the invention should not be limited to the above embodiments, but can be modified in various forms within a technical scope of the invention. It is needless to say that the invention covers these modifications.

INDUSTRIAL APPLICABILITY

The cooling device for the reinforcing barbinder according to the invention cools the interior of the reinforcing bar binder using the cooling fan. Therefore, during the continuous operation, the temperature does not rise to injure the binding machine. The protecting circuit is not actuated to forcibly stop the binding machine, thereby improving stability of the machine. Further, by means of the timer means for limiting the driving time of the cooling fan to a predetermined time and the means for on-off controlling the cooling fan according to the interior temperature of the reinforcing bar binder, the power consumption of the cooling fan can be reduced to the utmost. Furthermore, in the construction for on-off controlling the cooling fan according to the interior temperature of the reinforcing bar binder, if cooling is not required, the cooling fan is not actuated so that the binding performance at low temperatures is not deteriorated.

Further, in the construction in which the cooling fan is actuated when the trigger switch for the reinforcing bar binder is turned on and it is stopped after a predetermined time elapses, the temperature rise of the reinforcing bar binder can be suppressed and the endurance thereof can be improved.

The invention claimed is:

1. A motor-driven reinforcing bar binder comprising:

a binding wire feeding mechanism that feeds a binding wire so as to be wound around a reinforcing bar;

a binding wire twisting mechanism that grasps and twists the binding line wound around the reinforcing bar so as to bind the reinforcing bar;

a cooling fan device provided within a housing of the reinforcing bar binder;

a fan driving control unit that on-off controls the cooling fan device;

a temperature detecting device that detects an interior temperature of the reinforcing bar binder; and a comparison device that compares the detected temperature by the temperature detecting device with a reference temperature, wherein the fan driving control unit drives the cooling fan device when the interior temperature of the reinforcing bar binder exceeds the reference temperature.

2. The motor-driven reinforcing bar binder according to claim 1, further comprising:

a timer that counts a fan driving time, wherein the fan driving unit starts to drive the cooling fan device when the interior temperature of the reinforcing bar binder exceeds the reference temperature and a trigger signal for a binding operation is received, and stops the cooling fan device after a predetermined time elapses.

3. The motor-driven reinforcing bar binder according to claim 1, when the trigger signal for the binding operation is received during a period that the predetermined time elapses after a start of a driving of the cooling fan device, a counting operation by the timer is reset.

4. The motor-driven binding machine according to claim 1, further comprising:

a driving motor that drives the binding wire twisting mechanism, wherein the cooling fan device comprises a motor, a fan and a fan case.

5. The motor-driven binding machine according to claim 4, wherein the cooling fan device is arranged on a rear side of the driving motor and on or in a vicinity of an axial line of the driving motor.

6. A motor-driven reinforcing bar binder comprising:

a binding wire feeding mechanism that feeds a binding wire so as to be wound around a reinforcing bar;

a binding wire twisting mechanism that grasps and twists the binding line wound around the reinforcing bar so as to bind the reinforcing bar;

a cooling fan device provided within a housing of the reinforcing bar binder;

a fan driving control unit that on-off controls the cooling fan device;

a timer that counts a fan driving time, wherein the fan driving control unit starts to drive the cooling fan device when a trigger signal for a binding operation is received, and stops the cooling fan device after a predetermined time elapses.

7. The motor-driven reinforcing bar binder according to claim 6, further comprising:

a temperature detecting device that detects an interior temperature of the reinforcing bar binder; and a comparison device that compares the detected temperature by the temperature detecting device with a reference temperature, wherein the fan driving unit starts to drive the cooling fan device when the interior temperature of the reinforcing bar binder exceeds the reference temperature and a trigger signal for a binding operation is received, and stops the cooling fan device after the predetermined time elapses.

8. The motor-driven reinforcing bar binder according to claim 6, when the trigger signal for the binding operation is received during a period that the predetermined time elapses after a start of a driving of the cooling fan device, a counting operation by the timer is reset.

9. The motor-driven reinforcing bar binder according to claim 7, when the trigger signal for the binding operation is received during a period that the predetermined time elapses after a start of a driving of the cooling fan device, a counting operation by the timer is reset.

10. The motor-driven binding machine according to claim 6, further comprising:

a driving motor that drives the binding wire twisting mechanism, wherein the cooling fan device comprises a motor, a fan and a fan case.

11. The motor-driven binding machine according to claim 10, wherein the cooling fan device is arranged on a rear side of the driving motor and on or in a vicinity of an axial line of the driving motor.

* * * * *